US008414031B2

(12) United States Patent
Hirose et al.

(10) Patent No.: US 8,414,031 B2
(45) Date of Patent: Apr. 9, 2013

(54) INFORMATION CONCEALING LABEL

(75) Inventors: Kenji Hirose, Kasugai (JP); Kayoko Hayashi, Kasugai (JP); Masahiro Kimura, Kasugai (JP)

(73) Assignee: Kalbas Co., Ltd., Aichi (JP)

( * ) Notice: Subject to any disclaimer, the term of this patent is extended or adjusted under 35 U.S.C. 154(b) by 790 days.

(21) Appl. No.: 12/232,081

(22) Filed: Sep. 10, 2008

(65) Prior Publication Data

US 2009/0066075 A1 Mar. 12, 2009

(30) Foreign Application Priority Data

Sep. 12, 2007 (JP) ..... 2007-236761

(51) Int. Cl.
*B42D 15/00* (2006.01)

(52) U.S. Cl.
USPC ..... 283/81; 428/40.1

(58) Field of Classification Search ..... 283/81; 40/638, 674; 428/41.9
See application file for complete search history.

(56) References Cited

U.S. PATENT DOCUMENTS

| | | | | | |
|---|---|---|---|---|---|
| 4,889,234 | A * | 12/1989 | Sorensen et al. | ..... | 206/459.5 |
| 5,071,167 | A * | 12/1991 | O'Brien | ..... | 283/79 |
| 5,133,496 | A * | 7/1992 | Davidson et al. | ..... | 229/92.8 |
| 5,172,936 | A * | 12/1992 | Sullivan et al. | ..... | 283/81 |
| 5,586,788 | A * | 12/1996 | Laurash | ..... | 283/81 |
| 5,685,570 | A * | 11/1997 | Gray et al. | ..... | 283/71 |
| 6,616,189 | B2 * | 9/2003 | Raming | ..... | 283/81 |
| 7,048,308 | B2 * | 5/2006 | Blank | ..... | 283/81 |
| 7,575,791 | B2 * | 8/2009 | Chamandy et al. | ..... | 428/40.1 |
| 7,592,057 | B2 * | 9/2009 | Dronzek et al. | ..... | 428/40.1 |
| 8,114,451 | B2 * | 2/2012 | Sierra-Gomez et al. | ..... | 426/87 |
| 2004/0195824 | A1 * | 10/2004 | Blank | ..... | 283/81 |

FOREIGN PATENT DOCUMENTS

| | | |
|---|---|---|
| JP | 02-079074 | 3/1990 |
| JP | 6-332381 | 12/1994 |
| JP | 2002-311836 | 10/2002 |
| JP | 2004-059100 | 2/2004 |

* cited by examiner

*Primary Examiner* — Joanne Silbermann
*Assistant Examiner* — Shin Kim
(74) *Attorney, Agent, or Firm* — Wenderoth, Lind & Ponack, L.L.P.

(57) ABSTRACT

An information concealing label includes a label base and an adhesive layer on the back side thereof. The information concealing label is affixed by means of the adhesive layer onto an information writing section in which information to be concealed is written. The adhesive layer includes a strong adhesive portion positioned at the periphery of the label base and a weak adhesive portion positioned in the area inside the strong adhesive portion. The label base has a group of corrugated slits formed along the boundary between the weak adhesive portion and the strong adhesive portion. The weak adhesive portion of the label base can be peeled off the information writing section into an unsealed state with the strong adhesive portion adhering to the information writing section by cutting through the corrugated slits.

20 Claims, 7 Drawing Sheets

INFORMATION CONCEALING LABEL

CROSS REFERENCE TO RELATED APPLICATION

This application claims priority from Japanese Patent Application No. 2007-236761 filed Sep. 12, 2007. The entire content of this priority application is incorporated herein by reference.

TECHNICAL FIELD

The present disclosure relates to an information concealing label that is attached onto a postcard or other cards to conceal information.

BACKGROUND

When a postcard is used to notify personal and other information, an information concealing label is attached onto the postcard to conceal the personal information displayed on the postcard. Japanese Patent Laid-Open No. 6-332381 describes an example of such an information concealing label.

The information concealing label includes a label base formed of a paper or plastic film and an adhesive layer provided on the back side of the label base, and hence can be attached onto a postcard. Ink is printed on an inner portion of the adhesive layer surface but not on the periphery thereof. The portion of the adhesive layer that has ink printed thereon has a reduced adhesive strength, whereas the portion of the adhesive layer that has no ink printed thereon maintains an inherent adhesive strength. The adhesive layer therefore includes two kinds of adhesive portions: a strong adhesive portion positioned at the periphery and a weak adhesive portion positioned inside the periphery.

Further, the label base has perforations formed along the boundary between the weak adhesive portion and the strong adhesive portion described above, the perforations formed of short slits arranged linearly and intermittently. The label base can be cut along the perforations and the cut portion can be lifted.

The information concealing label is used in the following manner:

Information is first written in a predetermined information writing section printed on a postcard or any other card, and the information concealing label is overlaid and affixed onto the information writing section. The information written in the information writing section is thus concealed by the information concealing label. The strong adhesive portion positioned at the periphery of the back side of the information concealing label securely adheres to the postcard. Therefore, the information concealing label will neither peel off nor be peeled off even when one attempts to peel off the information concealing label itself, for example, during transportation of the mail because the strong adhesive portion positioned at the periphery has a strong adhesive strength; accordingly, no one can steal a glance at the information written in the information writing section. To look at the information written in the information writing section, the inner portion of the information concealing label must be removed by cutting through the perforations formed in the information concealing label and peeling off the weak adhesive portion. Therefore, in case that a malicious person has stolen a glance at the information during transportation of the mail, the perforations have been broken and a sign of such an action is left. A recipient can then notice that the information may have been leaked. Intact perforations in the received postcard ensure that information has not been leaked.

However, since the cuttable portion of the information concealing label of related art is formed of perforations linearly formed along the boundary, the cut surfaces of the perforations will not be fluffed but neatly aligned. Further, the weak adhesive portion of the adhesive layer can adhere again to the postcard even after peeled off the postcard. Therefore, a person other than a recipient can cut through the perforations and steal a glance at written information, and then reattach the weak adhesive portion of the information concealing label and neatly restore the cut perforations to original position. In this case, a recipient unlikely notices that the postcard has been opened.

SUMMARY

The present invention has been made in view of the above circumstances. An object of the present invention is to provide an information concealing label capable of preventing unauthorized opening thereof by designing the label to leave a positive sign of opening thereof when a weak adhesive portion of the information concealing label is once cut and lifted.

The information concealing label of the present invention includes a label base having front and back sides; an adhesive layer formed on the back side of the label base to be overlaid thereon, the adhesive layer including a strong adhesive portion positioned at the periphery of the label base and a weak adhesive portion positioned in the area surrounded by the strong adhesive portion, the weak adhesive portion having adherence weaker than that of the strong adhesive portion; and a peelable sheet peelably overlaid on the adhesive layer. The label base has a group of a large number of slits successively arranged along the boundary between the weak adhesive portion and the strong adhesive portion, and each of the slits crosses the boundary.

According to the above configuration, the information can be concealed by affixing the information concealing label by means of the adhesive layer onto a portion in which information to be concealed is written. Since the strong adhesive portion is formed at the periphery of the label base, the information concealing label cannot be peeled off easily. To open the information concealing label, the group of slits need to be broken and cut open along the boundary between the strong adhesive portion and the weak adhesive portion. In this case, portions of the label base between the slits are lifted and torn apart in an irregular manner. Therefore, any attempt to re-affix the weak adhesive portion once peeled off to the original position will not perfectly restore the original state. A sign of opening the information concealing label will be thus positively left.

BRIEF DESCRIPTION OF THE DRAWINGS

Illustrative aspects in accordance with the invention will be described in detail with reference to the following figures wherein.

DETAILED DESCRIPTION

An illustrative aspect of the present invention will be described below with reference to the drawings.

Figure 2:
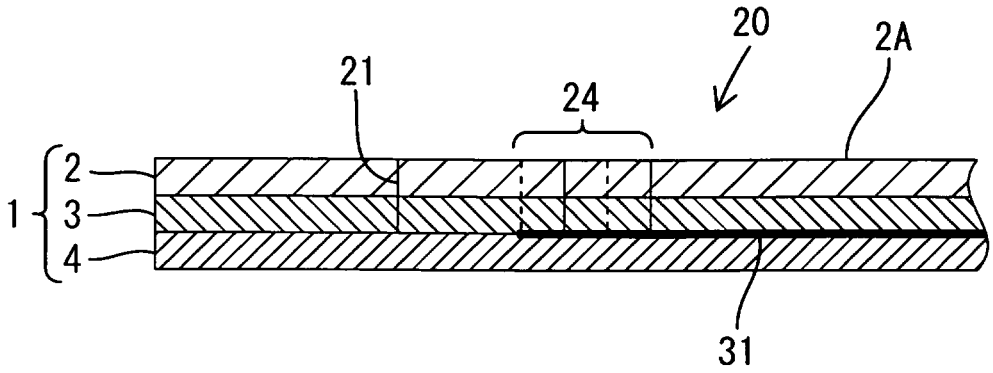
FIG. 2 is a cross-sectional view of the information concealing label shown in FIGS. 1A and 1B taken along the line A-A.

A label unit 1 that forms an information concealing label has a three-layer structure, as shown in FIG. 2, including a rectangular sheet base 2, an adhesive layer 3 applied onto the back side of the sheet base 2, and a peelable sheet 4 having the same shape and the same size as those of the sheet base 2, the peelable sheet 4 overlaid on the adhesive layer 3. The vertical dimension (short-side dimension) of the sheet base 2 is substantially the same as the vertical dimension of a regular-sized postcard, and the horizontal dimension (longitudinal dimension) of the sheet base 2 is approximately twice the horizontal dimension of a typical postcard.

Figure 1A:
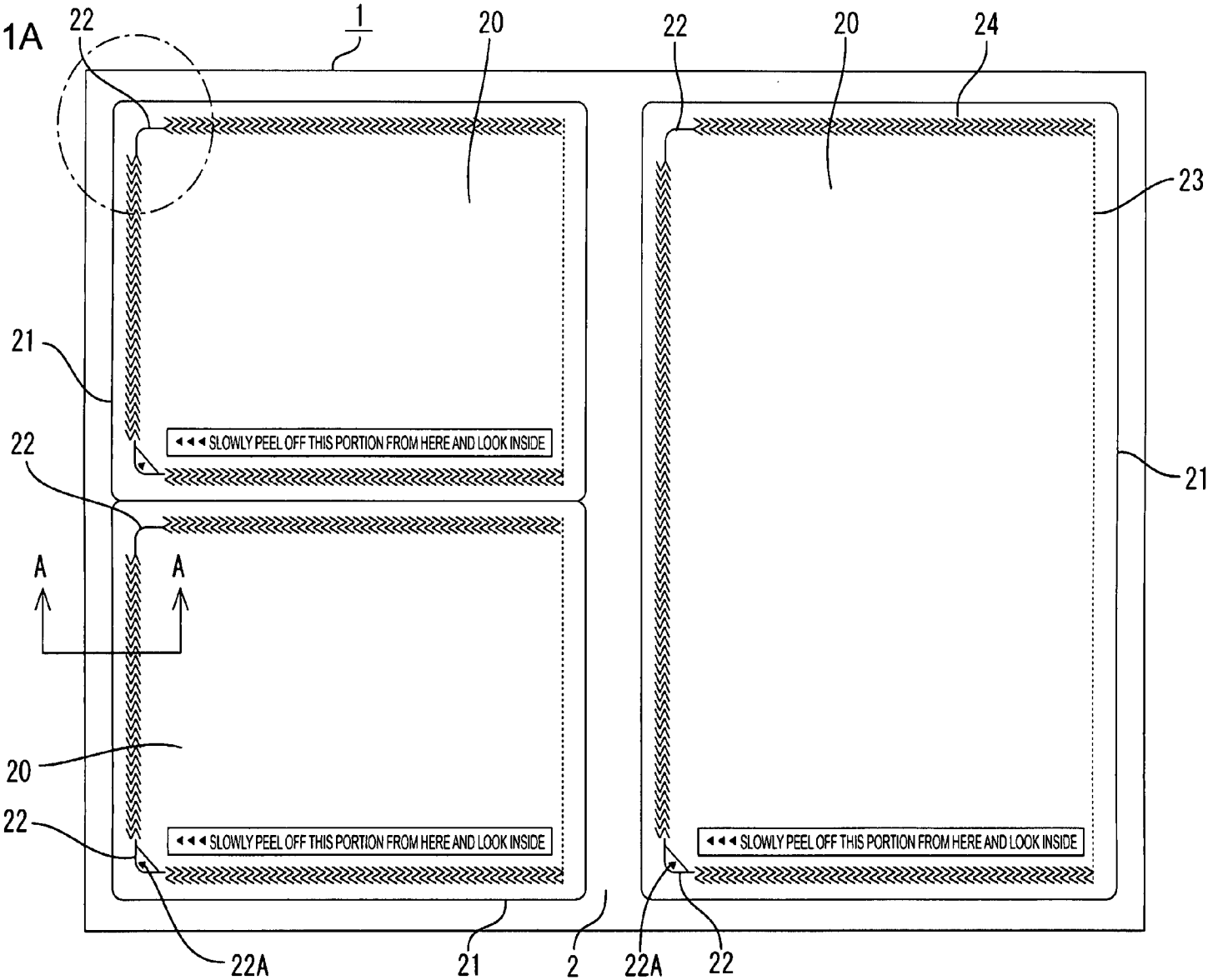
FIGS. 1A and 1B are front views of an information concealing label according to one aspect of the present invention.

The sheet base 2 is made of, for example, paper, and on the surface thereof are printed tint blocks (not shown) for preventing the sheet base 2 from being transparent, characters "Slowly peel off this portion from here and look inside," and arrows (see FIG. 1A).

The sheet base 2 is segmented into, for example, three areas in the present illustrative aspect: the right half having substantially the same size as that of a typical postcard, and the remaining left half further halved into upper and lower areas. Each of the areas has cuttable slits 21 at the periphery of the area, the slits arranged in a rectangular loop. The cuttable slits 21 segment the sheet base 2 into three separable label bases 2A. Each of the label bases 2A, when peeled along with the adhesive layer 3 off the peelable sheet 4, can be used as an individual information concealing label 20. That is, in the present illustrative aspect, a single label unit 1 can be cut into one postcard-sized information concealing label 20 and two information concealing labels 20 whose size is one-half the size of a postcard. The information concealing labels 20 are different in size but have the same basic function.

Figure 3:
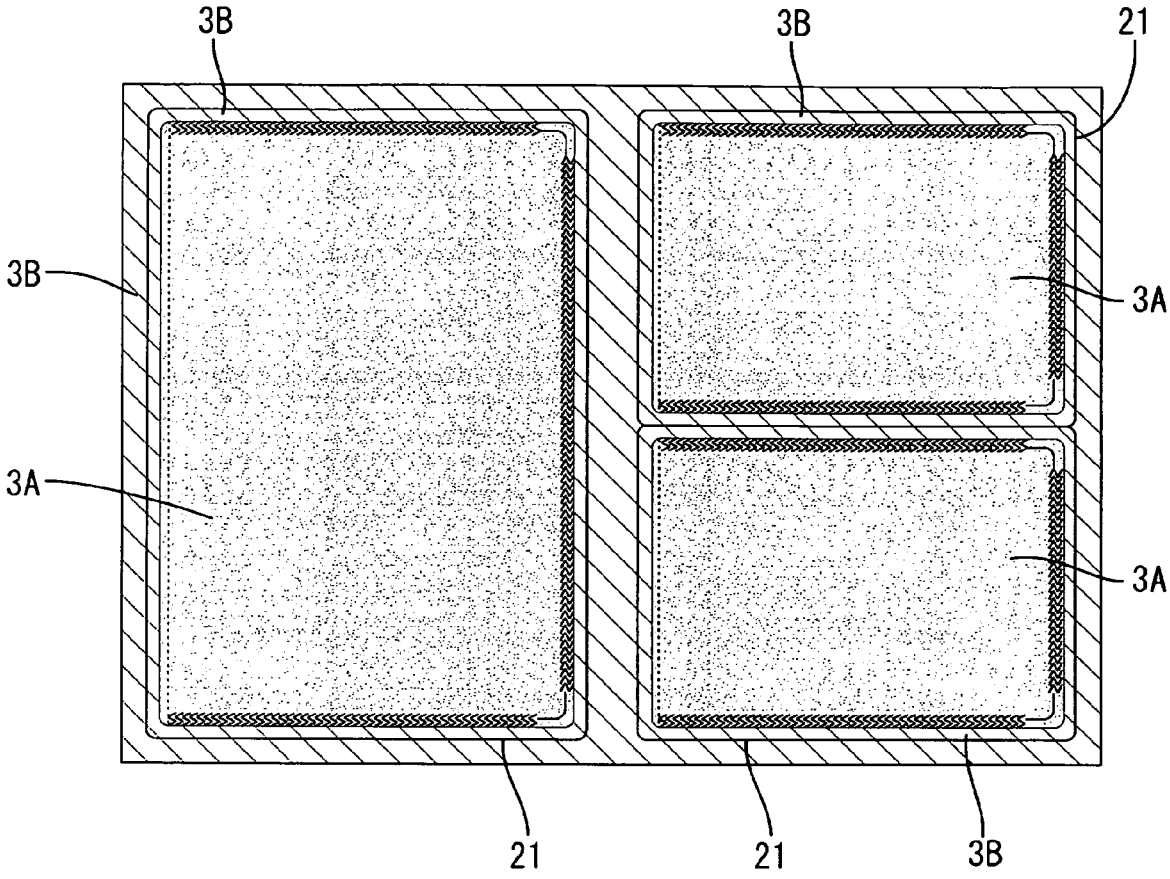
FIG. 3 is a rear view of the information concealing label 1 with a peelable sheet peeled off.

The configuration of the information concealing label 20 will now be described. An releasing ink 31 (shown only in FIG. 2) is printed on part of the adhesive layer 3 positioned on the back side of the sheet base 2, specifically on a rectangular area located inside the cuttable slits 21 but excluding the periphery having a width of approximately 5 mm. The releasing ink 31 is prepared by mixing a peeling varnish and a black ink, and printed, for example, using relief printing. Since the releasing ink 31, when attached, reduces adherence of an adhesive, the area on which the releasing ink 31 is printed has lower adherence than the peripheral unprinted area. In the present illustrative aspect, the rectangular area on which the releasing ink 31 is printed is called a weak adhesive portion 3A, and the surrounding frame-shaped area on which no releasing ink 31 is printed is called a strong adhesive portion 3B (FIG. 3).

The strong adhesive portion 3B (original adhesive), when once affixed to a postcard, has an adhesive strength that does not allow the strong adhesive portion to be peeled off, whereas the weak adhesive portion 3A, even when once affixed to the postcard, has an adhesive strength that allows the weak adhesive portion to be peeled off. The adherence of the weak adhesive portion 3A can be adjusted, for example, by changing the ratio of the area of the releasing ink 31 attached to the weak adhesive portion 3A to the entire area thereof (for example, the dot density when the portion to which the ink is attached is formed of dots or patterns) or the concentration of the peeling varnish when the releasing ink 31 is prepared.

Figure 1B:
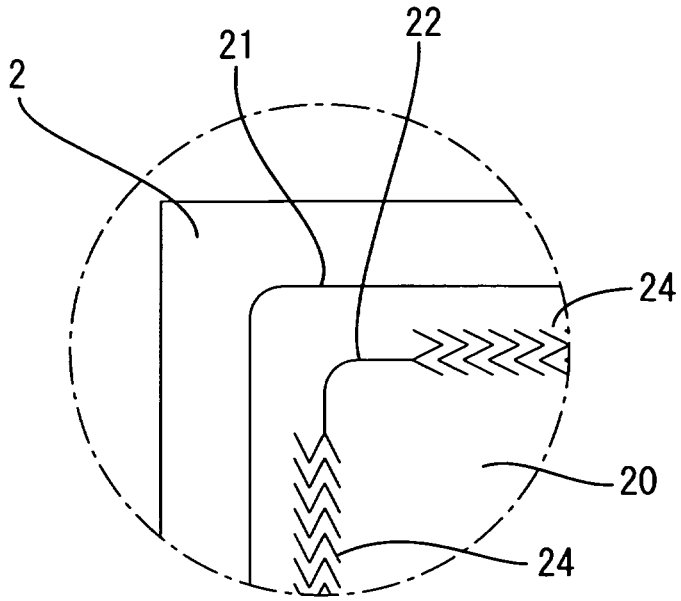

As described above, since the weak adhesive portion 3A is a rectangular area, the boundary between the weak adhesive portion 3A and the strong adhesive portion 3B is rectangular. Each of the label bases 2A has rounded L-shaped slits 22 at two locations, the upper and lower left corners along the boundary described above, each side of the L-shaped slit 22 being, for example, approximately 5 mm in length. A pinch mark 22A indicative of the position at which fingers can pinch the label is printed inside the lower L-shaped slit 22 (see FIG. 1A). Further, perforations 23 are formed along the right side extending vertically along the boundary described above, the perforations 23 formed of a group of short linear slits arranged intermittently along the boundary. In each of the portions that correspond to the other boundaries, a group of corrugated slits 24, each of which formed of straight lines inclined to the boundary, are arranged along the boundary. Each of the corrugated slits 24, as shown in the enlarged view of FIG. 1B, has the shape of a triangular wave in which a V shape and an inverted V shape arranged next to each other with one side of the V shape overlaid on one side of the inverted V shape. The lateral width W is, for example, approximately 3 mm, and the distance t between adjacent corrugated slits 24 is approximately 1 mm. The lateral width W of the corrugated slit 24 and the distance t between adjacent corrugated slits 24 can be specified as appropriate in accordance with the material of the sheet base 2 and the shape, the size, and other parameters of the information concealing label 20. In this illustrative aspect, it is preferable that the lateral width W ranges from 2 to 5 mm, and the gap distance t ranges from 0.5 to 2 mm.

The configuration of the information concealing label 20 according to the present illustrative aspect has been described above, and a description will now be made of a method for using the information concealing label 1 to cover an information writing section that takes up approximately one-half the area of a postcard 5.

Figure 4:
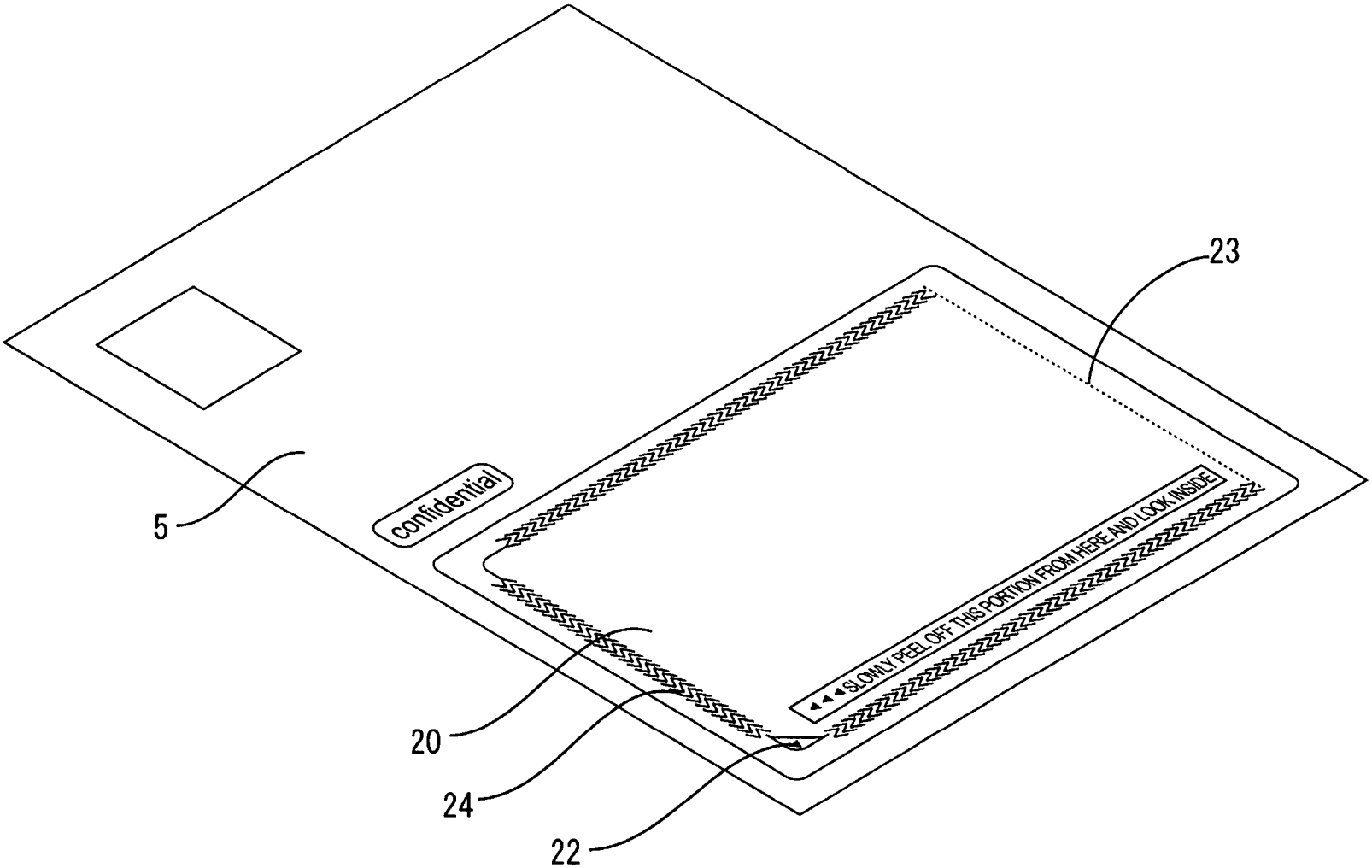
FIG. 4 is a perspective view of a postcard onto which the label is affixed.
Figure 5:
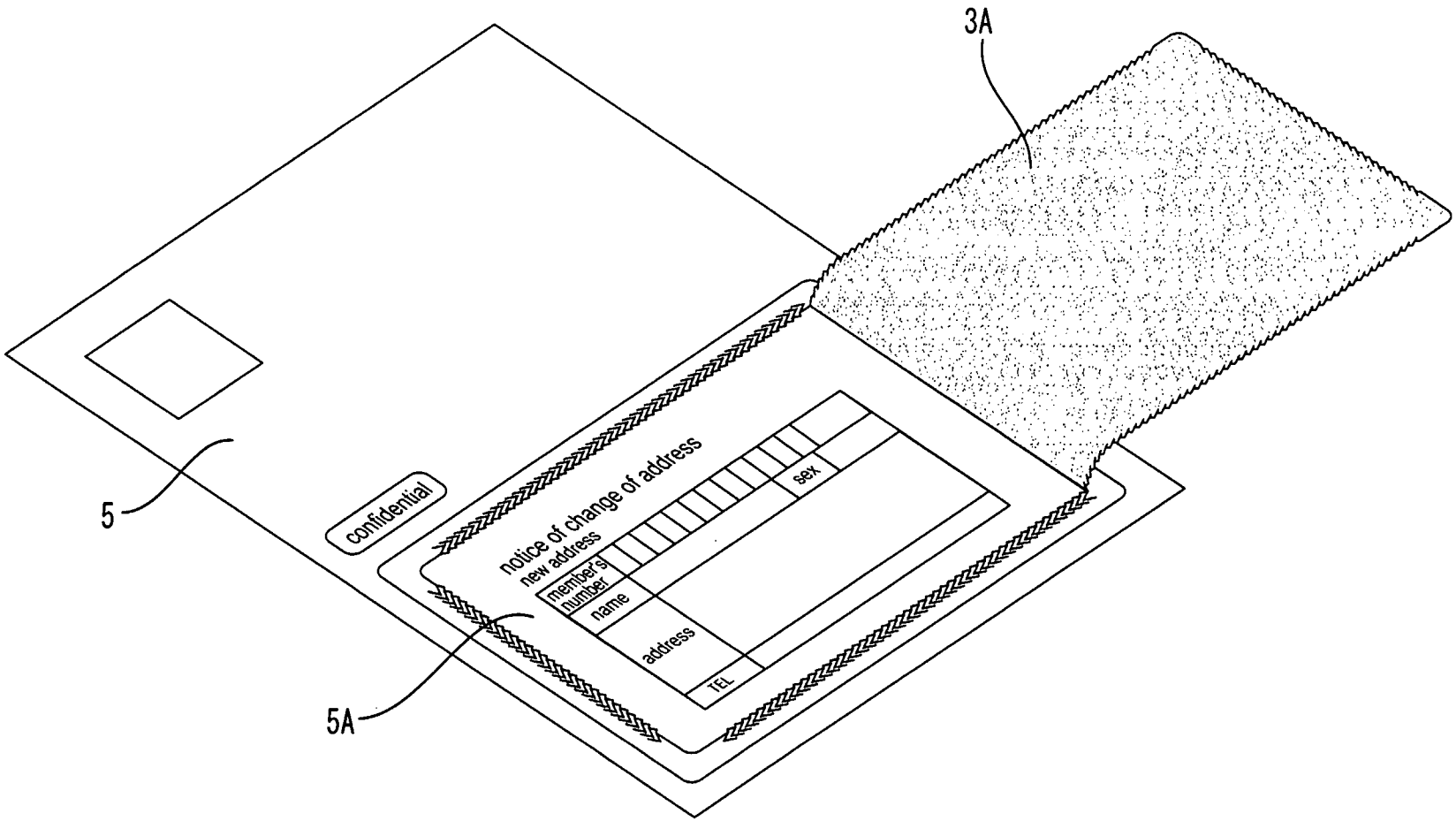
FIG. 5 is a perspective view showing the state in which a weak adhesive portion is peeled off the label shown in FIG. 4.

For example, assume that an information writing section 5A is provided in the lower half of the address side of the postcard 5 (FIG. 5). To conceal information written in the information writing section 5A and mail the postcard 5, the following steps are carried out: First, necessary information is written in the information writing section 5A, and the information concealing label 20, which is one-half a postcard in size, is peeled off the peelable sheet 4 along the cuttable slits 21 formed in the information concealing label 1. The information concealing label 20 is then affixed onto the postcard 5 in such a way that the weak adhesive portion 3A of the information concealing label 20 is overlaid on the information writing section 5A. The periphery of the information concealing label 20 is then pressed against the postcard 5 by using a finger to circle over the periphery. The information concealing label 20 is thus glued (FIG. 4).

The postcard 5 with the information concealing label 20 affixed thereto as described above is then mailed by dropping it into a mailbox, and the postcard 5 is mailed to an addressee with the information writing section 5A covered with the information concealing label 20. Since the portion outside the weak adhesive portion 3A is the strong adhesive portion 3B, the information concealing label 20 is unpeelably glued to the postcard 5, whereby the information concealing label 20 will not peel off, for example, during transportation of the mail. Further, even when one attempts to peel the information concealing label 20 off the postcard 5, the strong adhesive strength of the strong adhesive portion 3B positioned at the periphery of the information concealing label 20 does not allow the information concealing label 20 to be peeled off. No one can thus steal a glance at the information written in the information writing section 5A.

A recipient that has received the postcard 5 follows the instruction "Slowly peel off this from here and look inside" printed on the front side of the information concealing label 20, pinches the portion adjacent to the L-shaped slit 22 at the lower left corner, and peels off and lifts this portion. The portion of the information concealing label 20 between the L-shaped slit 22 and the corrugated slit 24 adjacent thereto is torn apart, and the end of the L-shaped slit 22 is connected to the corrugated slit 24. The portion between the corrugated slit 24 and the next corrugated slit 24 is then torn apart, and the cut portion becomes more widely open. The portion adjacent to the L-shaped slit 22 is further pulled with that portion being pinched, and adjacent corrugated slits 24 are successively torn apart. As a result, the portion between the weak adhesive portion 3A and the strong adhesive portion 3B is cut apart along the rectangular boundary, and the weak adhesive portion 3A is folded along the right-side perforations 23 and opened to the right thereof, as shown in FIG. 5. The information written in the information writing section 5A can thus be read.

Figure 6:
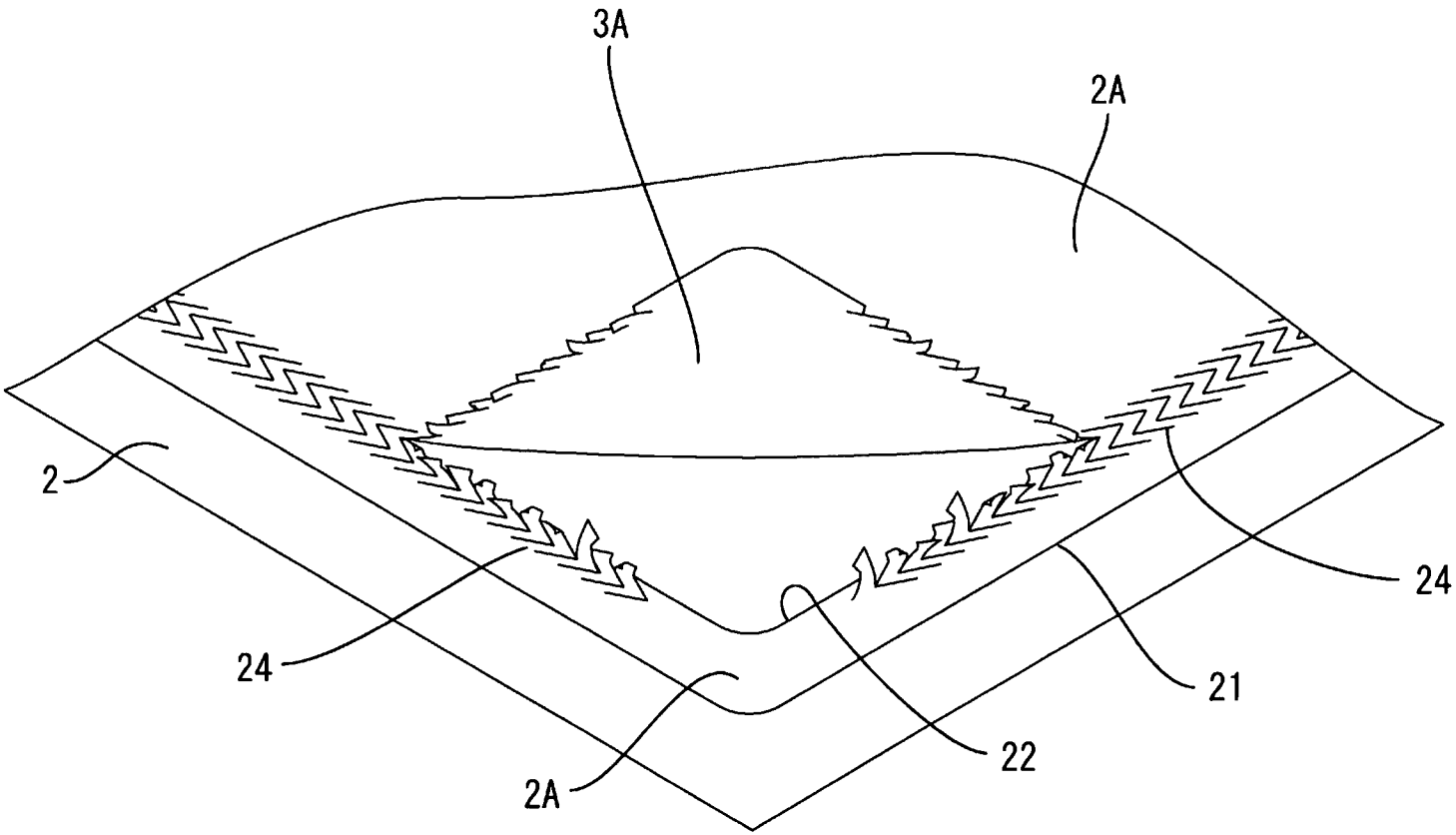
FIG. 6 is a perspective view showing the state in which corrugated slits are cut.

In the present illustrative aspect, the group of corrugated slits 24 are cut in order to open the area of the information concealing label 20 that corresponds to the weak adhesive portion 3A. Since each of the corrugated slits 24 is inclined to the boundary between the weak adhesive portion 3A and the strong adhesive portion 3B, parts of the base sheet 2A that are located between adjacent slits 24 are lifted off the postcard and torn apart in an irregular manner, as shown in FIG. 6. Therefore, any attempt to re-affix the weak adhesive portion 3A once peeled off to the original position will not perfectly restore the original state because portions between a large number of pairs of adjacent slits have been cut and lifted in an irregular manner. A sign of opening the postcard will be thus positively left. That is, in case a malicious person steals a glance at the information and re-affixes the weak adhesive portion 3A onto the information writing section 5A in the postcard 5 in order to cover it during transportation of the postcard 5, the corrugated slits 24 remain lifted and a sign of opening the postcard is positively left. A recipient can therefore notice that the information has probably been leaked. This means that it is possible to prevent unauthorized opening of the postcard by a person other than a recipient.

Further, since the weak adhesive portion 3A is formed by applying an adhesive that forms the strong adhesive portion 3B onto the entire area of the back side of the sheet base 2 and then printing the releasing ink 31 in an area excluding the periphery of the sheet base 2, it is not necessary to print two kinds of adhesives, and hence possible to reduce material cost and manufacturing cost.

<Other Illustrative Aspects>

The present invention is not limited to the illustrative aspect explained with reference to the above description and drawings. For example, the following illustrative aspects are included in the technical extent of the present invention.

(1) The above illustrative aspect has been described with reference to the information concealing label for concealing the contents written on a postcard, but the present invention is not limited to a postcard. The present invention is applicable to an information concealing label that is affixed to a card or the like that is sent or handed with information concealed.

(2) The above illustrative aspect has been described with reference to the case where a group of slits formed along the boundary between the weak adhesive portion and the strong adhesive portion are a large number of triangular wave-shaped slits arranged longitudinally, but each of the slits is not necessarily corrugated. A large number of short linear slits inclined to the boundary may be arranged along the boundary. Further, when corrugated slits are employed, each corrugated slit does not necessarily have a triangular-wave shape, but a sinusoidal or rectangular-wave shape can of course be used.

(3) In the above illustrative aspect, a non-adhesive, releasing ink is printed on an adhesive uniformly applied onto the back side of a sheet base in order to form a weak adhesive portion, but the present invention is not limited thereto. For example, the adherence may be reduced by performing chemical and physical treatment on part of the surface of the adhesive (for example, application of a releasing agent, thermal treatment, and electromagnetic wave irradiation). Alternatively, an adhesive is printed over a strong adhesive portion on the back side of a sheet base, whereas the adhesive is printed on a weak adhesive portion in such a way that the adhesive forms stripes or dots to reduce the amount of attached adhesive, whereby the adherence of the weak adhesive portion as a whole may be reduced. Of course, two kinds of adhesives having different adherence may be separately printed on the weak adhesive portion and the strong adhesive portion, respectively.

What is claimed is:

1. An information concealing label comprising:

a label base having front and back sides;

an adhesive layer formed on said back side of said label base, and an ink layer disposed on said adhesive layer so as to cover a portion of said adhesive layer, thereby forming a weak adhesive portion having a rectangular shape, said ink layer being disposed so as to be surrounded by said adhesive layer at a periphery of said label base, thereby forming a strong adhesive portion, said weak adhesive portion having adherence weaker than that of said strong adhesive portion; and a peelable sheet peelably overlaid on said adhesive layer, wherein said label base has a group of a large number of slits successively arranged along three linear sides of a rectangular boundary loop between said weak adhesive portion and said strong adhesive portion, and each of said slits along the three linear sides of the rectangular boundary loop extends in a direction transverse to a direction of a respective side of said boundary loop.

2. The information concealing label according to claim 1, wherein each of said slits is a straight line inclined in a direction toward said boundary loop.

3. The information concealing label according to claim 1, wherein each of said slits has a triangular-wave shape formed of two kinds of straight lines alternately arranged, and one kind of said straight lines is inclined in a first direction of said boundary loop, and another kind of said straight lines is inclined in a second direction of said boundary loop, the second direction being opposite the first direction.

4. The information concealing label according to claim 1, wherein said strong adhesive portion has a rectangular frame shape, said boundary loop between said weak adhesive portion and said strong adhesive portion has four corners, an L-shaped slit is formed at one corner of said four corners, and said group of slits is formed along said boundary loop starting from both ends of said L-shaped slit.

5. The information concealing label according to claim 1, wherein said strong adhesive portion has a rectangular frame shape, said boundary loop between said weak adhesive portion and said strong adhesive portion has four corners, an L-shaped slit is formed at each of two adjacent corners of said four corners, and linear perforations are formed in an area between the two remaining corners.

6. The information concealing label according to claim 4, wherein a pinch position mark is printed on said front side of said label base at said one corner where said L-shaped slit is formed.

7. The information concealing label according to claim 5, wherein a pinch position mark is printed on said front side of said label base at one corner of said two adjacent corners where said L-shaped slits are formed.

8. The information concealing label according to claim 1, wherein said label base is paper, and the distance between adjacent slits that form said group of slits has a value ranging from 0.5 to 2 mm.

9. The information concealing label according to claim 3, wherein said label base is paper, the distance between adjacent slits that form said group of slits has a value ranging from 0.5 to 2 mm, and the width of each of said slits in a direction perpendicular to said boundary loop has a value ranging from 2 to 5 mm.

10. The information concealing label according to claim 1, wherein said weak adhesive portion is formed by applying an adhesive that forms said strong adhesive portion onto an entire area of said back side of said label base and then printing a non-adhesive ink to be overlaid on an area excluding a periphery of said back side of said label base.

11. An information concealing label comprising:

a base sheet having front and rear sides, said base sheet having a plurality of cuttable slits arranged in a loop to segment said base sheet into a plurality of label bases;

an adhesive layer disposed on said rear side of said base sheet, and an ink layer disposed on said adhesive layer so as to cover a portion of said adhesive layer, thereby forming a weak adhesive portion, for each label base of said plurality of label bases, said ink layer is disposed so as to be surrounded by said adhesive layer at a periphery of said label base, thereby forming a strong adhesive portion at a periphery of said label base, and said weak adhesive portion is positioned in an area surrounded by said strong adhesive portion so as to form a rectangular boundary loop between said weak adhesive portion and said strong adhesive portion, said weak adhesive portion having adherence weaker than that of said strong adhesive portion; and a peelable sheet peelably overlaid on said adhesive layer, wherein each said label base has a group of a large number of slits successively arranged along three linear sides of said boundary loop between said weak adhesive portion and said strong adhesive portion, and each of said slits along the three linear sides of said rectangular boundary loop extends in a direction transverse to a direction of a respective side of said boundary loop.

12. The information concealing label according to claim 11, wherein each of said slits is a straight line inclined to said boundary loop.

13. The information concealing label according to claim 11, wherein each of said slits has a triangular-wave shape formed of two kinds of straight lines alternately arranged, and one kind of said straight lines is inclined in a first direction of said boundary loop, and another kind of said straight lines is inclined in a second direction of said boundary loop, the second direction being opposite the first direction.

14. The information concealing label according to claim 1, wherein said weak adhesive portion has a rectangular shape and said strong adhesive portion has a rectangular frame shape, said boundary loop between said weak adhesive portion and said strong adhesive portion has four corners, an L-shaped slit is formed at one corner of said four corners, and said group of slits is formed along said boundary loop starting from both ends of said L-shaped slit.

15. The information concealing label according to claim 11, wherein said weak adhesive portion has a rectangular shape and said strong adhesive portion has a rectangular frame shape, said boundary loop between said weak adhesive portion and said strong adhesive portion has four corners, an L-shaped slit is formed at each of two adjacent corners of said four corners, and linear perforations are formed in an area between the two remaining corners.

16. The information concealing label according to claim 14, wherein a pinch position mark is printed on said front side of said label base at said one corner where said L-shaped slit is formed.

17. The information concealing label according to claim 15, wherein a pinch position mark is printed on said front side of said label base at one corner of said two adjacent corners where said L-shaped slits are formed.

18. The information concealing label according to claim 11, wherein said label base is paper, and the distance between adjacent slits that form said group of slits has a value ranging from 0.5 to 2 mm.

19. The information concealing label according to claim 13, wherein said label base is paper, the distance between adjacent slits that form said group of slits has a value ranging from 0.5 to 2 mm, and the width of each of said slits in a direction perpendicular to said boundary loop has a value ranging from 2 to 5 mm.

20. The information concealing label according to claim 11, wherein said weak adhesive portion is formed by applying an adhesive that forms said strong adhesive portion onto an entire area of said rear side of said label base and then printing a non-adhesive ink to be overlaid on an area excluding a periphery of said rear side of said label base.

* * * * *